US008659482B2

(12) United States Patent
Kim et al.

(10) Patent No.: US 8,659,482 B2
(45) Date of Patent: Feb. 25, 2014

(54) MIMO ANTENNA HAVING PLURALITY OF ISOLATION ADJUSTMENT PORTIONS

(75) Inventors: Chan-Ho Kim, Incheon (KR); Jin-Myung Kim, Seongnam (KR); Jae-Ho Lee, Gumi (KR); Heung-Ju Ahn, Suwon (KR)

(73) Assignee: Mobitech Corp., Seoul (KR)

( * ) Notice: Subject to any disclaimer, the term of this patent is extended or adjusted under 35 U.S.C. 154(b) by 171 days.

(21) Appl. No.: 13/300,413

(22) Filed: Nov. 18, 2011

(65) Prior Publication Data

US 2012/0127038 A1 May 24, 2012

(30) Foreign Application Priority Data

Nov. 23, 2010 (KR) ..... 10-2010-0116730

(51) Int. Cl.
*H01Q 1/38* (2006.01)

(52) U.S. Cl.
USPC ..... 343/700 MS

(58) Field of Classification Search
USPC ..... 343/700 MS, 702, 846
See application file for complete search history.

(56) References Cited

U.S. PATENT DOCUMENTS

2009/0009400 A1* 1/2009 Kim et al. ..... 343/700 MS
2009/0322639 A1* 12/2009 Lai ..... 343/770
2010/0156726 A1* 6/2010 Montgomery et al. 343/700 MS
2011/0050528 A1* 3/2011 Montgomery ..... 343/795

FOREIGN PATENT DOCUMENTS

KR 10-2010-0064008 A 6/2010

OTHER PUBLICATIONS

KIPO Office Action for Korean Patent Application No. 10-2008-0122406 , Oct. 27, 2011.

* cited by examiner

*Primary Examiner* — Dieu H Duong
(74) *Attorney, Agent, or Firm* — LRK Patent Law Firm

(57) ABSTRACT

A Multiple-Input and Multiple-Output (MIMO) antenna having a plurality of isolation adjustment portions is provided. The MIMO antenna includes a plurality of radiation elements and a plurality of isolation adjustment portions. The plurality of radiation elements is symmetrically formed on the surfaces of the left and right sides of a dielectric element having a predetermined shape, is spaced apart from each other by a predetermined distance, operates in multiple frequency bands, and includes feeding portions, respectively. The plurality of isolation adjustment portions is coupled to the plurality of radiation elements so that they have electromagnetic characteristics different from those of the plurality of radiation elements, thereby improving isolation in each of the frequency bands in which the plurality of radiation elements operate.

11 Claims, 8 Drawing Sheets

MIMO ANTENNA HAVING PLURALITY OF ISOLATION ADJUSTMENT PORTIONS

CROSS REFERENCE TO RELATED APPLICATION

This application claims the benefit under 35 U.S.C. 119(a) of Korean Patent Application No. 10-2010-0116730, filed on Nov. 23, 2010, the disclosure of which is incorporated by reference in its entirety for all purposes.

BACKGROUND OF THE INVENTION

1. Field of the Invention

The present invention relates generally to a Multiple-Input and Multiple-Output (MIMO) antenna having a plurality of isolation adjustment portions and, more particularly, to a MIMO antenna, which has a plurality of isolation adjustment portions configured to be coupled to a plurality of radiation elements so that they have electromagnetic characteristics different from those of the plurality of radiation elements that operate in multiple frequency bands, thereby improving the isolation in each of the multiple frequency bands in which the plurality of radiation elements operate, and also diversifying the configuration of circuits and the implementation of design.

2. Description of the Related Art

With the recent increasing interest in the fourth-generation communication system capable of high-speed data transmission, related technologies are rapidly developing.

One of the main differences between the four-generation communication system and the previous-generation communication systems is the active adoption of MIMO technology that enables high-speed data transmission.

FIG. 1 is a diagram showing the configuration of a conventional MIMO antenna. As shown in FIG. 1, a plurality of radiation elements 1 and 2 that constitute parts of the conventional MIMO antenna respectively include feeding portions 3 and 4 via which feeding signals flow. Since the conventional MIMO antenna in which the plurality of radiation elements 1 and 2 is arranged and which performs a multiple-input and multiple-output operation is installed in a small-sized mobile communication terminal, the distance between the plurality of radiation elements 1 and 2 should be short. In this case, a problem arises in that the plurality of radiation elements 1 and 2 radiating electromagnetic waves interferes with each other due to current components flowing into the feeding portions 3 and 4 provided in the radiation elements 1 and 2 as feeding signals, and therefore the isolation is so poor as not to ensure high-speed data transmission. In order to overcome this problem, the distance between the feeding portions 3 and 4 included in the plurality of radiation elements 1 and 2 is set to a value equal to or greater than 0.5λ of an operation frequency band so as to improve the isolation in a narrow space. Alternatively, a slit corresponding to 0.25λ of a frequency band which is a target for the improvement of the isolation is formed in a ground surface 5, and therefore the flow of current components is directed to the slit formed in the ground surface 5, thereby reducing the mutual interference between electromagnetic waves radiated by the radiation elements.

However, the former case requires that a distance equal to or longer than a predetermined distance be always ensured, and the latter case prevents parts from being attached to the region of the ground surface where the slit is formed. Accordingly, both the cases have the problem of not being flexible in terms of the configuration of circuits and the implementation of design.

Although to solve the problem, technology for improving isolation by directing current components that influence feed points provided in a plurality of radiation elements to an isolation device using coupling was proposed, this technology has the problem that with regard to the radiation elements operating in multiple frequency bands, the improvement of isolation in a low frequency band is significantly greater than that in a high frequency band, and therefore there is a great difference in the improvement of isolation between individual frequency bands.

Accordingly, there is a pressing need for MIMO antenna technology that can uniformly improve isolation in all of the multiple frequency bands in which radiation elements operate and that can allow the configuration of circuits and the implementation of design to be diversified.

SUMMARY OF THE INVENTION

Accordingly, the present invention has been made keeping in mind the above problems occurring in the prior art, and an object of the present invention is to provide a MIMO antenna that includes a plurality of isolation adjustment portions configured to be coupled to a plurality of radiation elements so that they have electromagnetic characteristics different from those of the plurality of radiation elements and therefore the plurality of radiation elements operating in multiple frequency bands using the same signal can independently operate without interference, so that the effective improvement of isolation in each of the frequency bands in which the plurality of radiation elements operate can be accomplished, the distance between the individual antenna devices can be reduced, and the configuration of circuits and the implementation of design can be diversified.

In order to accomplish the above object, the present invention provides a MIMO antenna including a plurality of radiation elements symmetrically formed on the surfaces of the left and right sides of a dielectric element having a predetermined shape, spaced apart from each other by a predetermined distance, and configured to operate in multiple frequency bands and to include feeding portions, respectively, and a plurality of isolation adjustment portions configured to be coupled to the plurality of radiation elements so that they have electromagnetic characteristics different from those of the plurality of radiation elements, thereby improving isolation in each of the frequency bands in which the plurality of radiation elements operate.

Here, the plurality of isolation adjustment portions includes a first isolation adjustment portion formed of a metallic pattern line that connects first sides of the feeding portions included in the plurality of radiation elements, and a second isolation adjustment portion configured to include a plurality of parasitic elements formed to have a coupling structure in a one-to-one correspondence with the plurality of radiation elements with the dielectric element being disposed therebetween, and a bridge formed of a metallic pattern line that connects the plurality of parasitic elements.

Accordingly, the first isolation adjustment portion utilizes the band stop characteristic in which when the predetermined portions of the first sides of the feeding portions included in the plurality of radiation elements are connected to each other, each current component input to one of the feeding portions cannot flow into the other feeding portion, and the second isolation adjustment portion utilizes the electromagnetic induction characteristic in which current components input to the feeding portions included in the plurality of radiation elements are directed to the bridge electrically connecting the plurality of parasitic elements and are then caused to cancel each other by a structure in which the plurality of radiation elements are mutually coupled to the plurality of parasitic elements.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
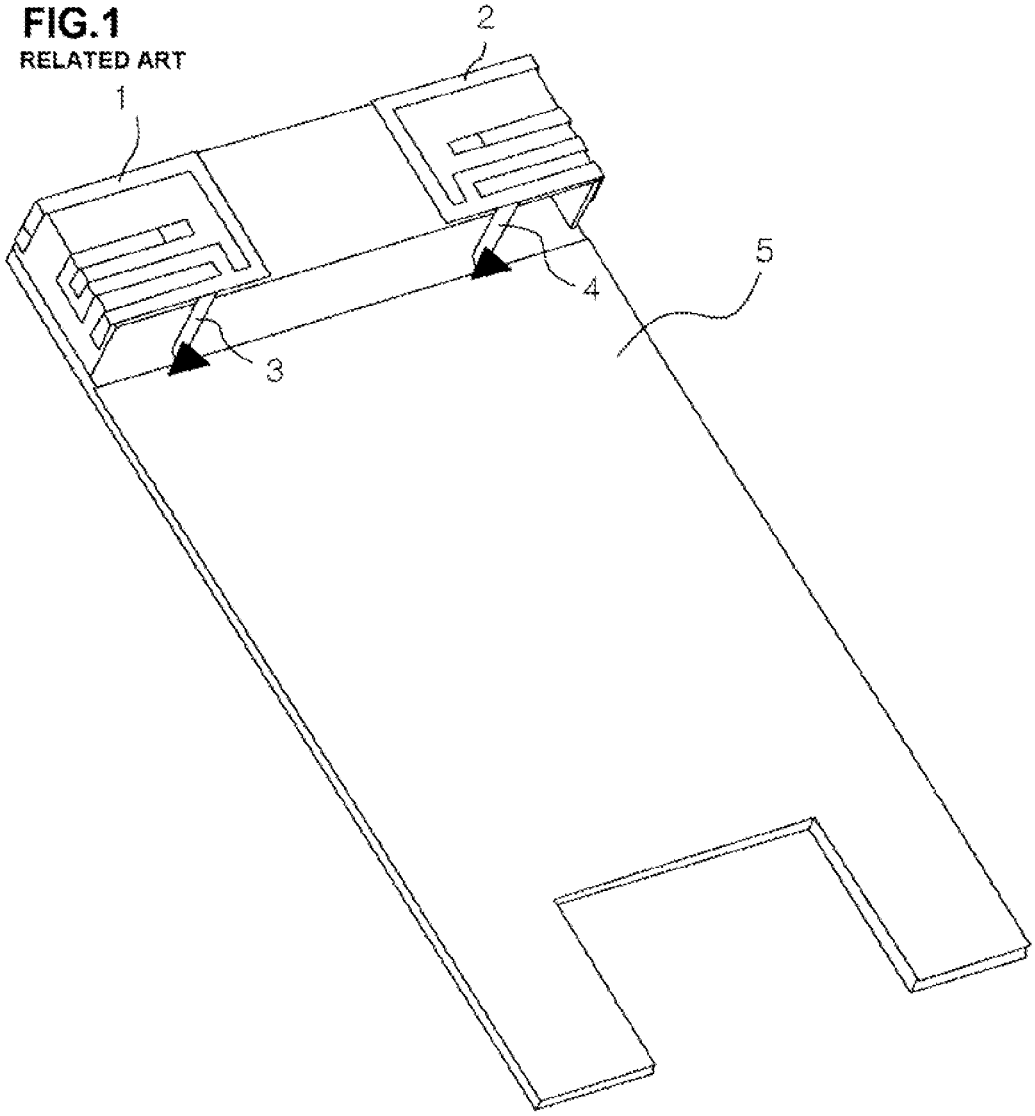
FIG.1 RELATED ART
FIG. 1 is a diagram showing the configuration of a conventional MIMO antenna.

Reference now should be made to the drawings, in which the same reference numerals are used throughout the different drawings to designate the same or similar components.

Preferred embodiments according to the present invention will be described in detail below with reference to the accompanying drawings.

Figure 2:
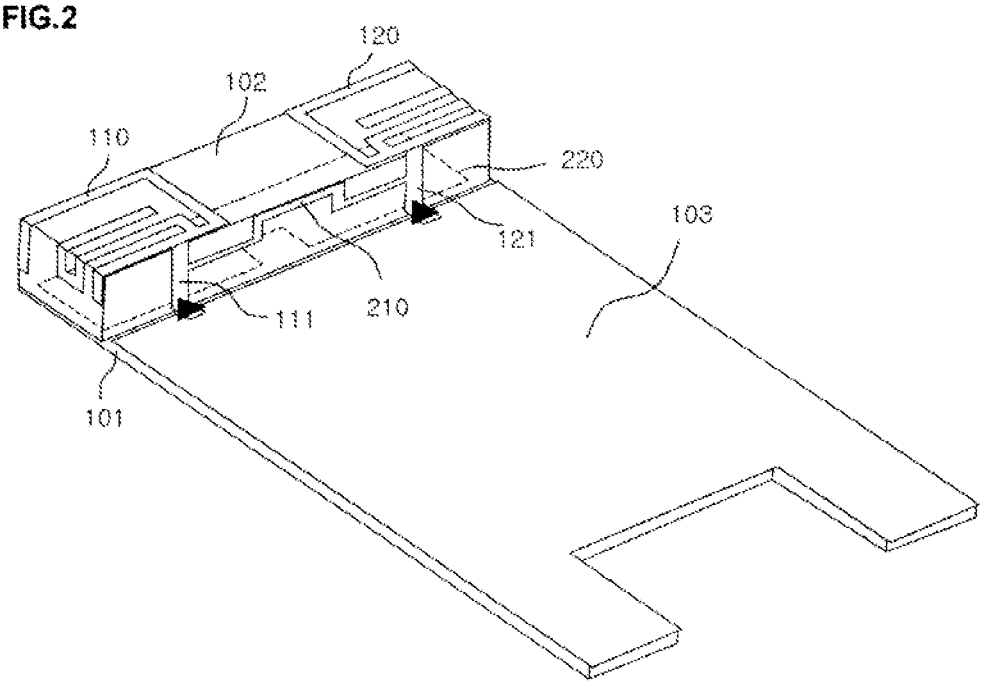
FIG. 2 is a diagram showing the configuration of a MIMO antenna having a plurality of isolation adjustment portions according to an embodiment of the present invention.

FIG. 2 is a diagram showing the configuration of a MIMO antenna 10 having a plurality of isolation adjustment portions according to an embodiment of the present invention.

As shown in FIG. 2, the MIMO antenna 10 having a plurality of isolation adjustment portions according to the embodiment of the present invention includes a dielectric element 102 configured to have a predetermined shape and formed on a surface of a board 101, a plurality of radiation elements 110 and 120 formed on a surface of the dielectric element 102 and provided with feeding portions 111 and 121, respectively, and a plurality of isolation adjustment portions 210 and 220 configured to be coupled to the plurality of radiation elements 110 and 120 so that they have electromagnetic characteristics different from those of the plurality of radiation elements 110 and 120.

In greater detail, the plurality of radiation elements 110 and 120 include first and second radiation elements 110 and 120 that are symmetrically formed on the left and right sides of the top surface of the dielectric element 102 having the predetermined shape and that are spaced apart from each other by a predetermined distance. The first and second radiation elements 110 and 120 respectively include the feeding portions 111 and 121 that feed signals.

Here, the first and second radiation elements 110 and 120 are radiation elements that normally operate in multiple frequency bands that are required by U.S. and European standard mWiMAX of IEEE 802.16e and the LTE system using a frequency band of 2 GHz~3 GHz. In this embodiment of the present invention, it is preferred that the first and second radiation elements 110 and 120 be radiation elements that ensure the frequency bands of a MIMO USB modem system which supports a dual frequency band including 2.6 GHz and 3.5 GHz and in which double resonance occurs and that also ensure radiation performance and bandwidth required by the services of the respective frequency bands.

Furthermore, the plurality of isolation adjustment portions 210 and 220 includes a first isolation adjustment portion 210 configured to connect predetermined portions of first sides of the feeding portions 111 and 121 included in the plurality of radiation elements 110 and 120, and a second isolation adjustment portion 220 formed on the bottom surface of the dielectric element 102 having a predetermined shape and connected to the plurality of radiation elements 110 and 120 in an electromagnetic coupling fashion with the dielectric element 102 being disposed therebetween.

Meanwhile, in order to support the antenna operation of the MIMO antenna having a plurality of isolation adjustment portions according to the embodiment of the present invention, a ground surface 103 formed of a metallic plate is formed on the board 101.

Figure 3:
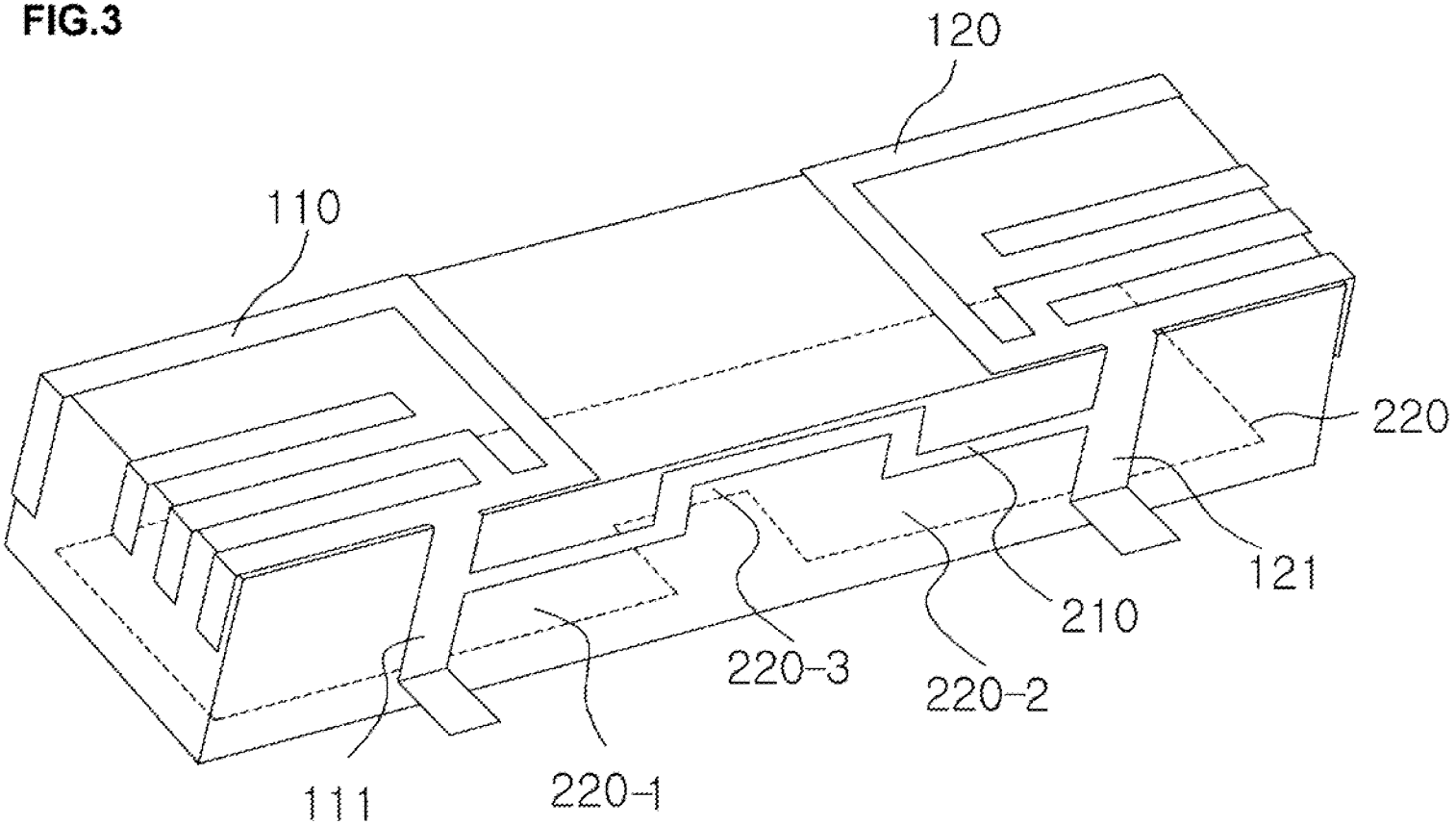
FIG. 3 is a top perspective view of the MIMO antenna according to the embodiment of the present invention.
Figure 4:
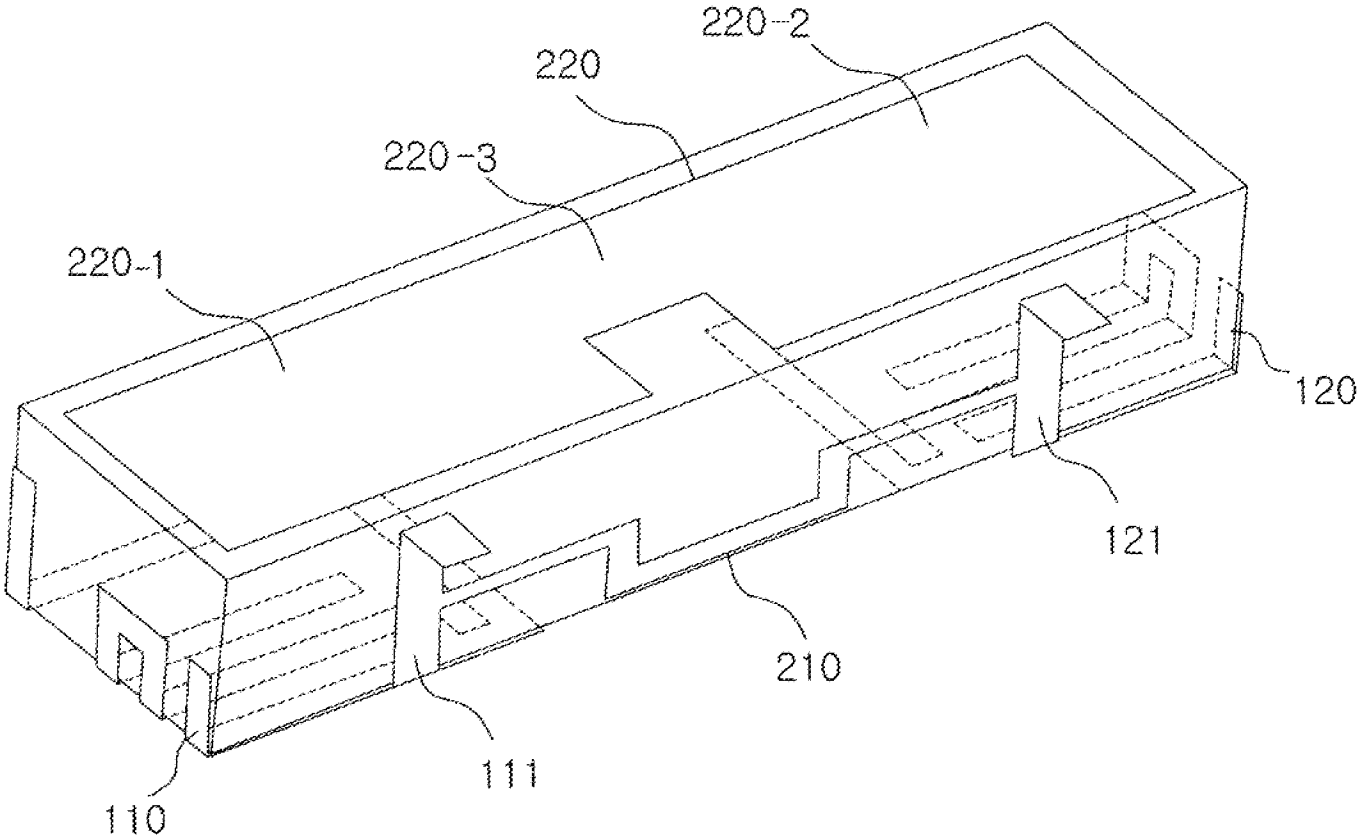
FIG. 4 is a bottom perspective view of the MIMO antenna according to the embodiment of the present invention.

FIG. 3 is a top perspective view of the MIMO antenna according to the embodiment of the present invention, and FIG. 4 is a bottom perspective view of the MIMO antenna according to the embodiment of the present invention.

The MIMO antenna according to the embodiment of the present invention will now be described in greater detail with reference to FIGS. 3 and 4.

As shown in FIGS. 3 and 4, the plurality of isolation adjustment portions 210 and 220 included in the MIMO antenna 10 according to the embodiment of the present invention include the first and second isolation adjustment portions 210 and 220 as described above. The first isolation adjustment portion 210 utilizes the band stop characteristic in which when the predetermined portions of the first sides of the feeding portions 111 and 121 included in the plurality of radiation elements 110 and 120 are connected to each other, each current component input to one of the feeding portions 111 and 121 cannot flow into the other feeding portion. The second isolation adjustment portion 220 utilizes the electromagnetic induction characteristic in which current components input to the feeding portions 111 and 121 included in the plurality of radiation elements 110 and 120 are directed to a bridge 220-3 electrically connecting the plurality of parasitic elements 220-1 and 220-2 and are then caused to cancel each other by a structure in which the plurality of radiation elements 110 and 120 are mutually coupled to the plurality of parasitic elements 220-1 and 220-2.

In greater detail, the first isolation adjustment portion 210 is implemented using a metallic pattern line that connects the predetermined portions of the first sides of the feeding portions 111 and 112 included in the plurality of radiation elements 110 and 120, and improves the isolation in the relatively high frequency band of the dual frequency band in which the first and second radiation elements 110 and 120 operate using the band stop characteristic that prevents each current component input to one of the feeding portions 111 and 112 from flowing into the other feeding portion.

Furthermore, the second isolation adjustment portion 220 is formed in such a way that the plurality of parasitic elements 220-1 and 220-2 formed of metallic plates of a predetermined size that are attached to the bottom surface of the dielectric element 102 in a one-to-one correspondence with the first and second radiation elements 110 and 120 with the dielectric element 102 being disposed therebetween is integrated with the bridge 220-3 formed of a metallic pattern line that mutually connects the plurality of parasitic elements 220-1 and 220-2.

Here, the plurality of parasitic elements 220-1 and 220-2 included in the second isolation adjustment portion 220 are spaced apart from the ground surface 103 by a predetermined interval, and are first used to stabilize resonance that occurs in the low frequency band of the first and second radiation elements 110 and 120.

Furthermore, the plurality of parasitic elements 220-1 and 220-2 are mutually coupled to the first and second radiation elements 110 and 120 in a one-to-one correspondence therewith, and then direct current components input to the feeding portions 111 and 121 included in the plurality of radiation elements 110 and 120.

Furthermore, since the bridge 220-3 is formed of a metallic pattern line having a predetermined width that connects the parasitic elements 220-1 and 220-2, it directs current components that are coupled between the plurality of radiation elements 110 and 120 and the plurality of parasitic elements 220-1 and 220-2.

Accordingly, thanks to the coupling phenomenon, current components input to the feeding portions 111 and 121 included in the plurality of radiation elements 110 and 120 are directed to and flow through the parasitic elements 220-1 and 220-2. The current components that flow through the edges of the ground surface 103 formed on the board 101 and influence the feeding portions of the other radiation elements, and current components that flow through the parasitic elements 220-1 and 220-2 are directed in a direction towards the center of the second isolation adjustment portion 220 where the bridge 220-3 is formed. Accordingly, the current components that influence the feeding portions of the other radiation elements cancel each other at the bridge 220-3, thereby improving the isolation in the relatively low frequency band of the dual frequency band in which the first and second radiation elements 110 and 120 operate.

As described above, the MIMO antenna having a plurality of isolation adjustment portions according to the embodiment of the present invention has the plurality of isolation adjustment portions 210 and 220 configured to be coupled to the plurality of radiation elements 110 and 120 so that they have electromagnetic characteristics different from those of the plurality of radiation elements 110 and 120, and has the advantage of providing improved isolation in each frequency band to the plurality of radiation elements that operate in multiple bands.

Figure 5:
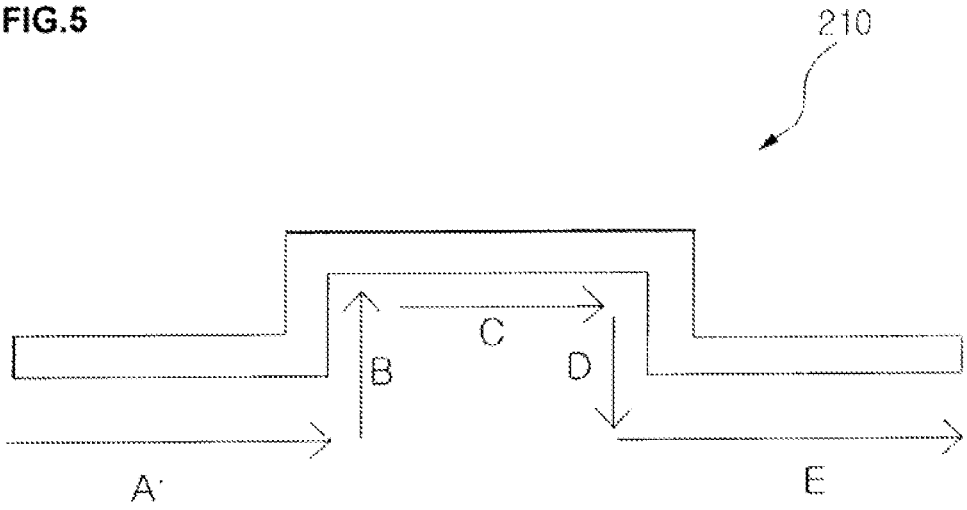
FIG. 5 is a diagram showing the configuration of a first isolation adjustment portion according to an embodiment of the present invention.
Figure 6:
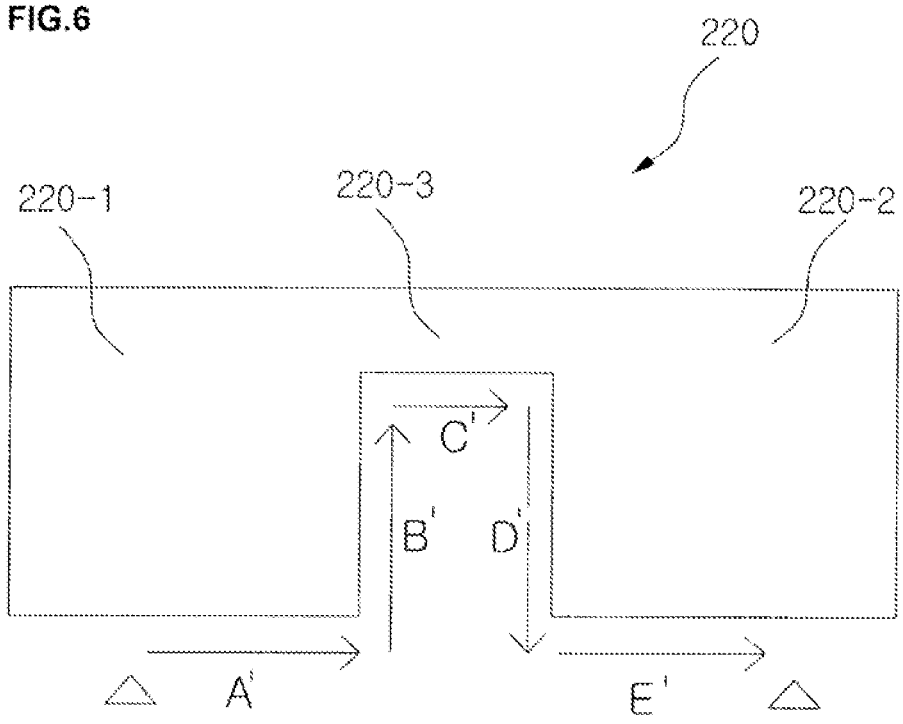
FIG. 6 is a diagram showing the configuration of a second isolation adjustment portion according to an embodiment of the present invention.

FIG. 5 is a diagram showing the configuration of a first isolation adjustment portion according to an embodiment of the present invention, and FIG. 6 is a diagram showing the configuration of a second isolation adjustment portion according to an embodiment of the present invention.

The distance between a plurality of radiation elements 110 and 120 based on which the isolation can be ensured by a plurality of isolation adjustment portions 210 and 220 according to the embodiment of the present invention will now be described with reference to FIGS. 5 and 6.

In the embodiment of the present invention, each of the plurality of isolation adjustment portions 210 and 220 intended to improve the isolation in multiple frequency bands has a length that correspond to 0.25λ of a band which is a target for the improvement of the isolation. This length is the same as the length of the path of current components that flow between the feeding portions 111 and 121 included in the plurality of radiation elements 110 and 120 when the first and second radiation elements 110 and 120 operate.

Here, the length of the path of the current components of the first isolation adjustment portion 210 shown in FIG. 5 is the length that is obtained by summing paths A, B, C, D and E, and the length of the path of current components of the second isolation adjustment portion 220 shown in FIG. 6 is the length that is obtained by summing paths A", B", C", D", and E."

In an embodiment of the present invention, the first isolation adjustment portion 210 is formed to substantially have a sideways "U"-shaped section by bending a metallic pattern line a plurality of times. It is preferred that the length of the paths of current components, formed on the first isolation adjustment portion 210 be 0.25λ of a frequency band which is a target for the improvement of the isolation.

Furthermore, in an embodiment of the present invention, the second isolation adjustment portion 220 is substantially formed in a sideways "U" shape by cutting out any of the upper and lower sides of the longitudinally central portion of a metallic plate. It is preferred that the length of the paths of current components formed on the second isolation adjustment portion 220 be 0.25λ of a frequency band which is a target for the improvement of the isolation.

The distance between the plurality of radiation elements 110 and 120 according to an embodiment of the present invention is, for example, 12 mm, which corresponds to 0.1λ on the basis of a low frequency band having a resonance frequency of 2.6 GHz, and which corresponds to 0.14λ on the basis of a high frequency band having a resonance frequency of 3.6 GHz.

As described above, in the MIMO antenna according to the embodiment of the present invention, the isolation is ensured by the plurality of isolation adjustment portions, and therefore the distance between the plurality of radiation elements is reduced compared to that in conventional MIMO antenna technology.

Accordingly, the MIMO antenna according to the embodiment of the present invention having a plurality of isolation adjustment portions allows the spatial arrangement for the configuration of circuits and the implementation of design to be flexible, and enables a plurality of radiation elements to normally perform radiation thanks to ensured isolation even when they operate at the same time.

Figure 7:
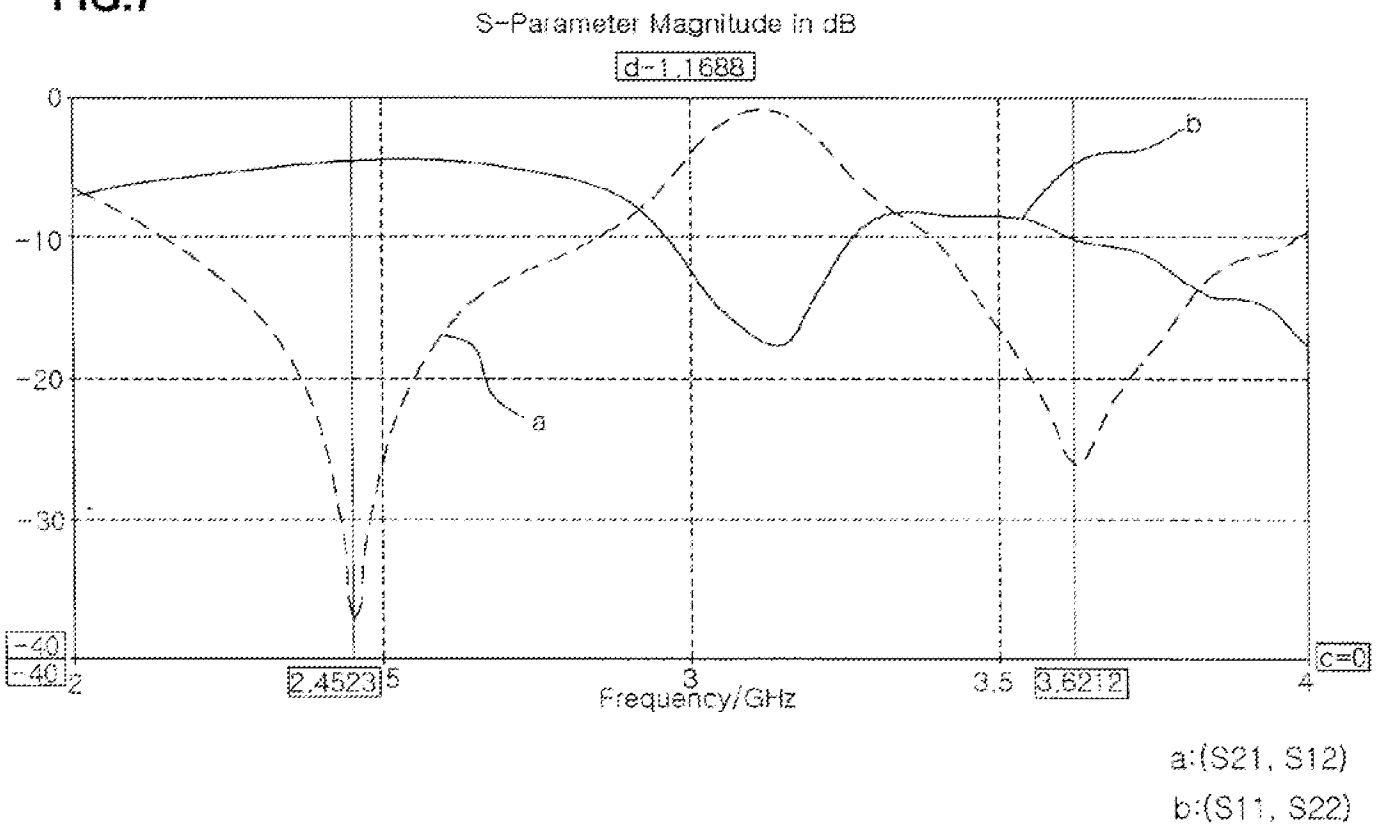
FIG. 7 is a diagram showing the actually measured values of the isolation of the MIMO antenna to which the embodiment of the present invention has not been applied.
Figure 8:
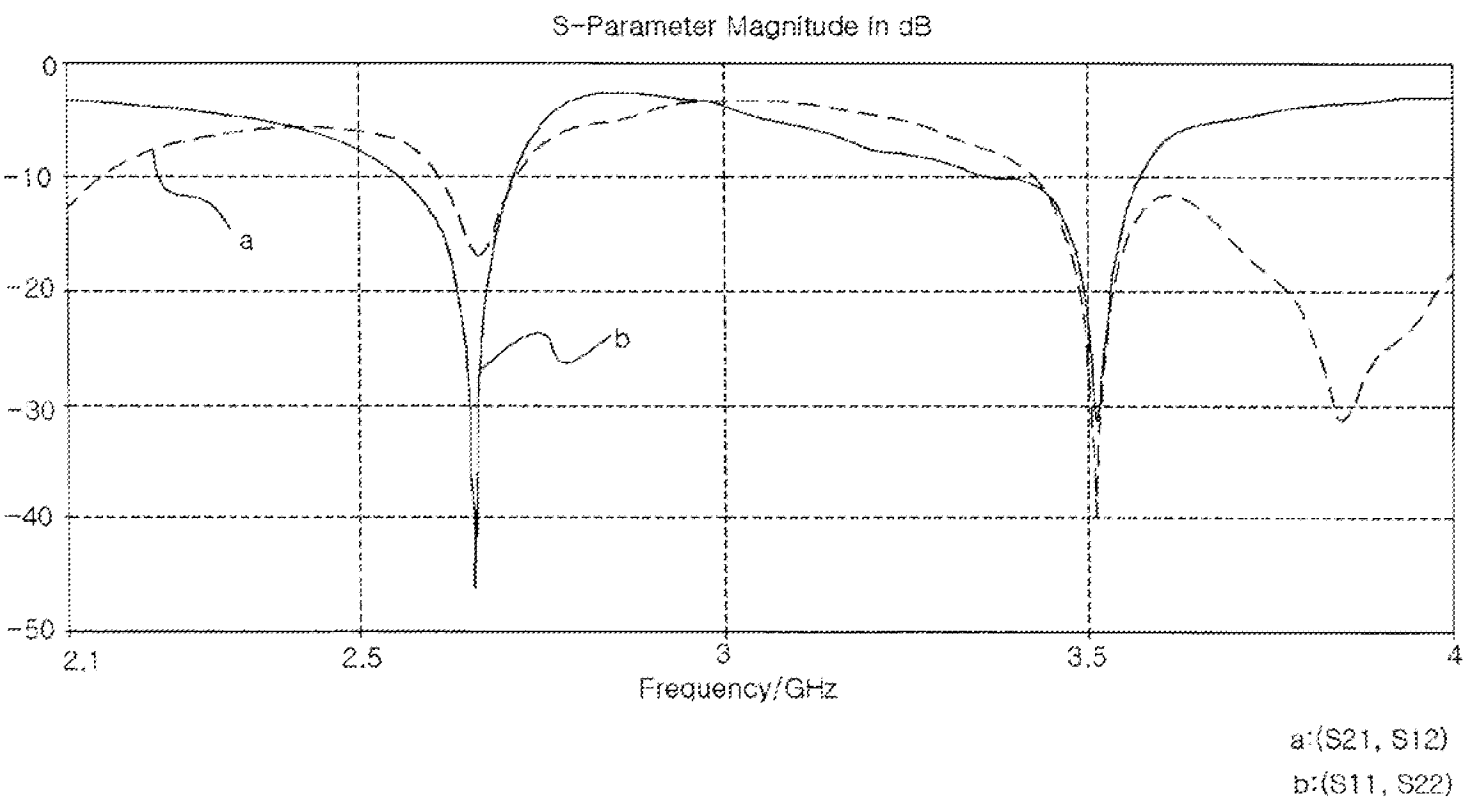
FIG. 8 is a diagram showing the actually measured values of the isolation of the MIMO antenna to which the embodiment of the present invention has been applied.

FIG. 7 is a diagram showing the actually measured values of the isolation of the MIMO antenna to which the embodiment of the present invention has not been applied, and FIG. 8 is a diagram showing the actually measured values of the isolation of the MIMO antenna to which the embodiment of the present invention has been applied.

As shown in FIGS. 7 and 8, reference character "a" denotes the resonance frequency band, and the reference character "b" denotes the return loss, that is, the actually measured value of the isolation.

In an embodiment of the present invention, a plurality of radiation elements 110 and 120 is designed in the same environment having the same resonance frequency band, and therefore a single line is plotted due to overlapping.

The optimally required isolation of the multiple frequency bands in which the plurality of radiation elements 110 and 120 operates is equal to or lower than −15 dB.

From FIG. 7, it can be seen that the MIMO antenna to which the embodiment of the present invention has not been applied resonates at 2.4 GHz and 3.6 GHz and has an isolation of −5 dB at 2.4 GHz and an isolation of −10 dB at 3.6 GHz.

From FIG. 8, it can be seen that the MIMO antenna to which the embodiment of the present invention has been applied resonates at 2.6 GHz and 3.5 GHz and has an improved isolation of about −18 dB at 2.6 GHz and an improved isolation of about −22 dB at 3.6 GHz.

As described above, the present invention has the effect of providing the MIMO antenna that includes a plurality of isolation adjustment portions configured to be coupled to a plurality of radiation elements so that they have electromagnetic characteristics different from those of the plurality of radiation elements and therefore the plurality of radiation elements operating in multiple frequency bands using the same signal can independently operate without interference, so that the effective improvement of isolation in each of the frequency-bands in which the plurality of radiation elements operate can be accomplished, the distance between the individual antenna devices can be reduced, and the configuration of circuits and the implementation of design can be diversified.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A Multiple-Input and Multiple-Output (MIMO) antenna having a plurality of isolation adjustment portions, comprising:

a plurality of radiation elements symmetrically formed on surfaces of left and right sides of a dielectric element having a predetermined shape, spaced apart from each other by a predetermined distance, and configured to operate in multiple frequency bands and to include feeding portions, respectively;

a first isolation adjustment portion formed of a metallic pattern line that connects first sides of the feeding portions included in the plurality of radiation elements, and a second isolation adjustment portion, the second isolation adjustment portion comprising a plurality of parasitic elements formed to have a coupling structure in a one-to-one correspondence with the plurality of radiation elements with the dielectric element disposed therebetween, and a bridge formed of a metallic pattern line that connects the plurality of parasitic elements.

2. The MIMO antenna as set forth in claim 1, wherein a length of a path of current components formed on the first isolation adjustment portion is 0.25λ of a frequency band which is a target for improvement of isolation.

3. The MIMO antenna as set forth in claim 2, wherein the first isolation adjustment portion is formed to substantially have a sideways "U"-shaped section by bending a metallic pattern line a plurality of times.

4. The MIMO antenna as set forth in claim 3, further comprising a second isolation adjustment portion, the second isolation adjustment portion comprising a plurality of parasitic elements formed to have a coupling structure in a one-to-one correspondence with the plurality of radiation elements with the dielectric element disposed therebetween, and a bridge formed of a metallic pattern line that connects the plurality of parasitic elements.

5. The MIMO antenna as set forth in claim 4, wherein a length of a path of current components formed on the second isolation adjustment portion is 0.25λ of a frequency band which is a target for improvement of isolation.

6. The MIMO antenna as set forth in claim 5, wherein the second isolation adjustment portion is substantially formed in a sideways "U" shape by cutting out any of upper and lower sides of a longitudinally central portion of a metallic plate.

7. The MIMO antenna as set forth in claim 2, further comprising a second isolation adjustment portion, the second isolation adjustment portion comprising a plurality of parasitic elements formed to have a coupling structure in a one-to-one correspondence with the plurality of radiation elements with the dielectric element disposed therebetween, and a bridge formed of a metallic pattern line that connects the plurality of parasitic elements.

8. The MIMO antenna as set forth in claim 7, wherein a length of a path of current components formed on the second isolation adjustment portion is 0.25λ of a frequency band which is a target for improvement of isolation.

9. The MIMO antenna as set forth in claim 8, wherein the second isolation adjustment portion is substantially formed in a sideways "U" shape by cutting out any of upper and lower sides of a longitudinally central portion of a metallic plate.

10. The MIMO antenna as set forth in claim 1, wherein a length of a path of current components formed on the second isolation adjustment portion is 0.25λ of a frequency band which is a target for improvement of isolation.

11. The MIMO antenna as set forth in claim 10, wherein the second isolation adjustment portion is substantially formed in a sideways "U" shape by cutting out any of upper and lower sides of a longitudinally central portion of a metallic plate.

* * * * *